US007070008B2

(12) United States Patent
Baumann et al.

(10) Patent No.: US 7,070,008 B2
(45) Date of Patent: Jul. 4, 2006

(54) DRILL OR CHISEL HAMMER

(75) Inventors: Otto Baumann, Leinfelden/Echterdingen (DE); Dietmar Saur, Gomaringen (DE)

(73) Assignee: Robert Bosch GmbH, Stuttgart (DE)

( * ) Notice: Subject to any disclaimer, the term of this patent is extended or adjusted under 35 U.S.C. 154(b) by 199 days.

(21) Appl. No.: 10/240,962

(22) PCT Filed: Jan. 17, 2002

(86) PCT No.: PCT/DE02/00113

§ 371 (c)(1),
(2), (4) Date: Dec. 24, 2002

(87) PCT Pub. No.: WO02/064321

PCT Pub. Date: Aug. 22, 2002

(65) Prior Publication Data

US 2004/0020668 A1 Feb. 5, 2004

(30) Foreign Application Priority Data

Feb. 9, 2001 (DE) ..... 101 06 034

(51) Int. Cl.
*B25D 16/00* (2006.01)

(52) U.S. Cl. ..... 173/48; 173/109; 173/201

(58) Field of Classification Search ..... 173/48, 173/200, 201, 118, 109, 104, 97, 148; 74/72 R, 74/300, 339; 192/53.1, 69.5, 69.82, 56.55
See application file for complete search history.

(56) References Cited

U.S. PATENT DOCUMENTS

| | | | | |
|---|---|---|---|---|
| 4,284,148 | A * | 8/1981 | Wanner et al. | 173/109 |
| 4,732,217 | A * | 3/1988 | Bleicher et al. | 173/104 |
| 4,895,212 | A | 1/1990 | Wache | |
| 5,036,925 | A * | 8/1991 | Wache | 173/48 |
| 5,277,259 | A * | 1/1994 | Schmid et al. | 179/109 |
| 5,320,177 | A * | 6/1994 | Shibata et al. | 173/48 |
| 5,435,397 | A * | 7/1995 | Demuth | 173/109 |
| 5,566,458 | A * | 10/1996 | Bednar | 192/56.55 |
| 5,588,496 | A * | 12/1996 | Elger | 173/178 |
| 5,603,516 | A * | 2/1997 | Neumaier | 279/19.5 |
| 6,035,945 | A * | 3/2000 | Ichijyou et al. | 173/48 |
| 6,138,772 | A * | 10/2000 | Miescher et al. | 173/109 |
| 6,192,996 | B1 * | 2/2001 | Sakaguchi et al. | 173/48 |
| 6,460,627 | B1 * | 10/2002 | Below et al. | 173/48 |

FOREIGN PATENT DOCUMENTS

| | | |
|---|---|---|
| DE | 38 04 414 A | 8/1989 |
| DE | 43 02 083 A1 | 7/1994 |
| EP | 0 331 619 A | 9/1989 |
| EP | 0 608 083 A1 | 1/1994 |

* cited by examiner

OTHER PUBLICATIONS

Lechner, G., et al:Fahrzeuggetriebe. Springer, 1994, p. 237, Bild 9.10.ISBR 3-540-57423-9

*Primary Examiner*—Scott A. Smith
(74) *Attorney, Agent, or Firm*—Michael J. Striker

(57) ABSTRACT

The invention is based on a power tool having a beater mechanism (14) and a coupling device (12, 100), which can be engaged and disengaged in order to make and break a drive connection (16, 102) of the beater mechanism (14).

It is proposed that the coupling device (12, 100) has a synchronizing device (18, 112), with a detent mechanism (20, 110) which transmits a drive moment and which in a synchronizing operation has at least two corresponding detent elements (22, 24, 108), at least one of the detent elements (22) being movable about its detent position upon an overlooking moment, counter to the spring force of a spring element (26, 116).

13 Claims, 7 Drawing Sheets

DRILL OR CHISEL HAMMER

BACKGROUND OF THE INVENTION

The invention is based on a drill- and/or chipping hammer.

Drill- and/or chipping hammers with pneumatic beater mechanisms are known that can be activated and deactivated via a mechanical friction coupling. If the drill- and/or chipping hammer is pressed with a tool against a machining surface, a tool holder that holds the tool is guided, in the direction of a user, into a housing of the drill- and/or chipping hammer. In the process, conical friction faces of the friction coupling come into contact, and the pneumatic beater mechanism is driven via a nonpositive engagement. During operation, with an axially movable piston guided in a cylinder, the beater mechanism generates a cushion of compressed air, which accelerates a beater in the axial direction against an impact bolt. The beater strikes the impact bolt, which thereby experiences a pulse.

If the drill- and/or chipping hammer with the tool is lifted from the machining surface, the frictional faces of the friction coupling are disconnected by a so-called idling spring, and the drive connection of the beater mechanism is broken.

SUMMARY OF THE INVENTION

The invention is based on a power tool having a beater mechanism and a coupling device, which can be engaged and disengaged in order to make and break a drive connection of the beater mechanism.

It is proposed that the coupling device has a synchronizing device, with a detent mechanism which transmits a drive moment and which in a synchronizing operation has at least two corresponding detent elements, at least one of the detent elements being movable about its detent position upon an overlooking moment, counter to a spring force of a spring element. With the detent mechanism, by means of an unlockable positive engagement, an advantageous synchronizing device can be created which at even a slight coupling force is capable of transmitting a relatively high torque. Because only slight coupling forces are required, an especially comfortable power tool can be achieved, which can be guided into its working position with only slight force on the part of the user.

As a result of the unlockable positive engagement, synchronization can advantageously be achieved over a short distance, and the synchronization is largely independent of the viscosity of a lubricant used in the coupling device. A damped engagement is also attainable with the synchronizing device, and a coupling device with little wear can be achieved.

Advantageously, the detent element that is movable counter to a spring force is formed by a roller body, and the detent element, corresponding to the detent element embodied as a roller body, is formed by a recess. The roller body can be formed for instance by a ball, roller, barrel, and so forth. The detent elements can roll in the overlooking process, and the wear can be reduced. The recess can be especially adapted to the rolling of the roller body, and uniform, low-wear synchronization can be achieved. If roller bodies embodied as rollers are used, then large transmission surface areas can be achieved, and in comparison with balls, greater torques can be transmitted, while conversely, with balls, a rolling motion in more than two directions can advantageously be achieved and canting can be avoided.

Fundamentally, however, still other detent elements that appear useful to one skilled in the art can also be used, such as sliding blocks and the like.

In a first feature of the invention, it is proposed that the detent element embodied as a roller body is movable out of its detent position counter to an annular spring. A simple, space-saving construction with only one spring element can be achieved. The annular spring can be embodied in various ways, for instance as a single spring with a means of securing against rotation, a single spring without a means for securing against rotation and with a suitably embodied slot, which despite the tensed spring prevents the detent elements embodied as roller bodies from escaping, or as a spring packet, as a result of which a high spring force with low spring tension can advantageously be achieved.

If the detent element, at the onset of the synchronizing operation, is displaced along a conical face counter to the annular spring, then with a small axial force, a high radial force and thus a high synchronizing force can be attained. The conical face and/or the detent element with the annular spring can be embodied so that it is axially movably supported. With the conical face, a boost in the axial force can be attained, specifically because a greater axial motion with a lesser axial force can be converted into a lesser radial motion with a greater radial force. Moreover, the detent element embodied as a roller body can be guided into the detent element embodied as a recess with a continuous motion, and a uniform acceleration and advantageous engagement can be attained. Preferably, the detent element embodied as a recess has a dome-shaped cross-sectional area.

Advantageously, the conical face is formed onto one end of a component that is displaceable axially and fixed against relative rotation on a drivable shaft, and a detent element embodied as a recess extends into the conical face. The synchronizing device can be realized in a space-saving, structurally simple manner, with only a few additional components.

In a further feature of the invention, it is proposed that at the onset of the synchronizing operation, the detent element is guidable radially outward along the conical face. An existing installation space radially outward can advantageously be utilized, and a large, low-tolerance spring can be used. In principle, however, it is also conceivable to dispose the detent elements radially outside an annular spring and to embody them as movable radially inward counter to the annular spring.

If a component that transmits a pulse of the beater mechanism is connected to the displaceable component via a connection, which transmits a force in the pulse direction, then the pulse for attaining the idling position can be utilized, and a restoring spring or idling spring can be reinforced in its action. Advantageously, the restoring spring can be embodied smaller than in a conventional engagement coupling, and a low user force and a high degree of comfort can be attained.

It is also proposed that a root inner circle of at least two detent elements embodied as recesses has the same diameter as a root inner circle of the detent elements embodied as roller bodies, in an idling position. At a standstill, the roller bodies can be guided unhindered, without loading the spring, into the recesses, and simple engagement and disengagement can be achieved. Moreover and in particular, it can be attained that the annular spring is not under load while the tool is in a working position.

In a second feature of the invention, it is proposed that the detent element is formed by a ball, which is braced on a conical ring that is displaceable on a drivable shaft axially counter to a spring. The spring can take on the function of a synchronizing spring and an idling spring, so that additional components, installation space, weight and expense can be saved. With the conical ring, a boost is attainable with which a slight axial force can be converted into a strong radial force and a strong synchronizing force.

If the conical ring, once the drive connection is made, is axially fixed by a stop, the detent element can be used to establish a positive-engagement connection, and additional positive-engagement elements can be dispensed with.

It is also proposed that the detent element embodied as a ball is braced radially inward on the displaceable conical ring and can be brought radially outward into operative connection with the corresponding detent element as a recess. Existing installation space in the radial direction outward can advantageously be utilized. In principle, however, it is also conceivable for the detent elements to be braced radially outward on an axially displaceable conical ring.

If the detent element is supported in one part of a drive element, in particular a drive bearing, of the beater mechanism, then existing components can be used, and additional components, installation space and expense can be saved.

If the coupling device has positive-engagement elements, which after the synchronizing operation come into engagement next to the detent mechanism, then the detent mechanism can be relieved during operation, and the wear on the detent elements can be reduced.

BRIEF DESCRIPTION OF THE DRAWINGS

Further advantages will become apparent from the ensuing drawing description. In the drawings, exemplary embodiments of the invention are shown. The drawings, descriptions and claims include numerous characteristics in combination. One skilled in the art will expediently consider the characteristics individually as well and put them together to make useful further combinations.

Shown are.

DETAILED DESCRIPTION OF THE PREFERRED EMBODIMENTS

Figure 1:
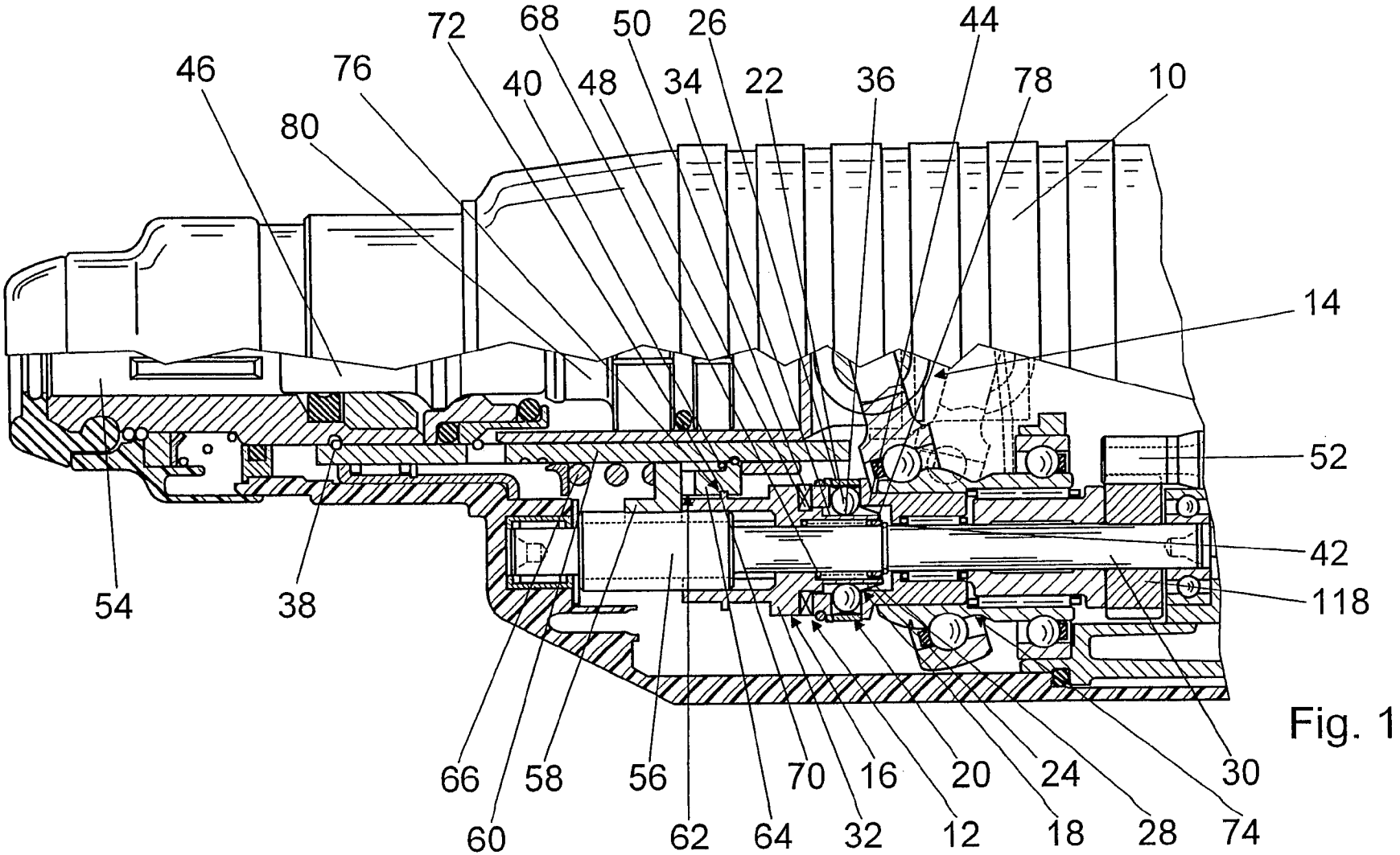
FIG. 1, a fragmentary section through a drill- and/or chipping hammer.

FIG. 1 shows a fragmentary section through a drill- and/or chipping hammer, with an electric motor, not shown in further detail, that is disposed in a housing 10 and has a drive shaft 52. Formed onto the drive shaft 52 is a pinion, which meshes with a fixed wheel 118 disposed on a shaft 30 that extends parallel to the drive shaft 52. The shaft 30, on a side toward a tool holder 54, has a formed-on gear wheel 56, by way of which the shaft 30 meshes with a gear wheel 58 disposed on a hammer tube 60. The gear wheel 58 is supported rotatably on the hammer tube 60 and is connected, via roller bodies of an overlock coupling 62, to a detent disk 64 that is disposed in a manner fixed against relative rotation on the hammer tube 60. The hammer tube 60 is in turn connected in a manner fixed against relative rotation to the tool holder 54.

A beater mechanism 14 is rotatably supported with a drive bearing 74 on the shaft 30. Also supported on the shaft 30 is a coupling device 12, which can be engaged and disengaged to make and break a drive connection 16 of the beater mechanism 14. On the side of the gear wheel 56 remote from the tool holder 54, the coupling device 12 has a first coupling element 32, supported on the shaft 30 axially displaceably but in a manner fixed against relative rotation. The first coupling element 32, on its end toward the tool holder 54, has a set of internal teeth, with which the first coupling element 32 is guided in a manner fixed against relative rotation but axially displaceably on the gear wheel 56. On an end remote from the tool holder 54, one part of a synchronizing device 18, specifically a conical face 28, whose diameter increases in the direction of the tool holder 54, is formed onto an outer circumference of the first coupling element 32 (FIGS. 1–5). Instead of a conical face, still other faces that appear useful to one skilled in the art may also be formed on, such as convex and/or concave faces, whose diameters preferably increase in the direction of the tool holder. The synchronizing behavior can advantageously be varied by means of how the face is embodied.

Figure 5:
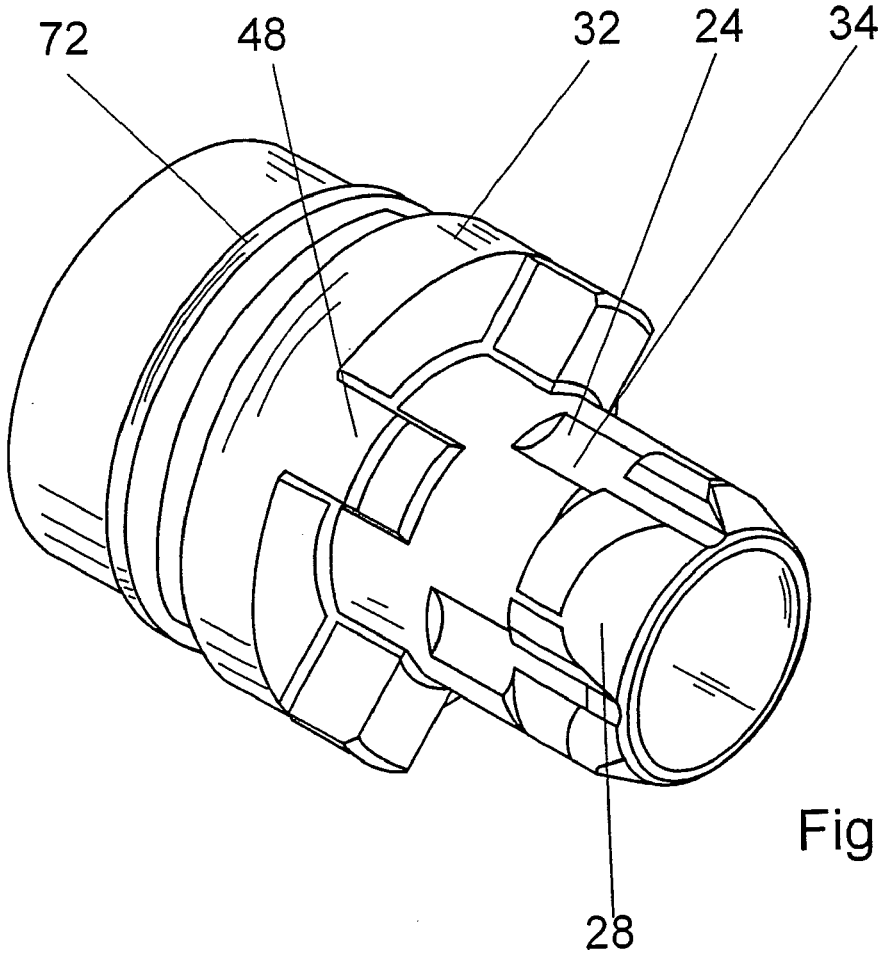
FIG. 5, a coupling element of the coupling device of FIG. 2, seen obliquely from above.

Originating in the conical face 28 are detent elements 24, embodied as recesses and extending in the direction of the tool holder 54, of a detent mechanism 20 of the synchronizing device 18 (FIGS. 1 and 5). The detent elements 24 embodied as recesses have a domelike cross-sectional area. To achieve gentle engagement, the transitions in the circumferential direction to the recesses are rounded in the region of the conical face 28 (FIG. 5).

The first coupling element 32 protrudes, with its end remote from the tool holder 54, into a second, corresponding coupling element 44, which furthermore forms one part of the drive bearing 74 of the beater mechanism 14. In the second coupling element 44, detent elements 22 of the detent mechanism 20 that are embodied as balls are supported in a plurality of radially extending bores distributed over the circumference. In an idling position of the drill- and/or chipping hammer, the detent elements 22 embodied as balls protrude radially inward with one part, past an inner circumference of the second coupling element 44, and in the process are braced radially inward, each on a respective formed-on collar in the bores. The detent elements 22 embodied as balls form a root inner circle 36, which has the same diameter as a root inner circle 34 of the detent elements 24 embodied as recesses (FIGS. 1–4). Moreover, the number of balls matches the number of recesses, so that the first and second coupling elements 32, 44, at a standstill of the drill- and/or chipping hammer, can be joined without force.

Figure 2:
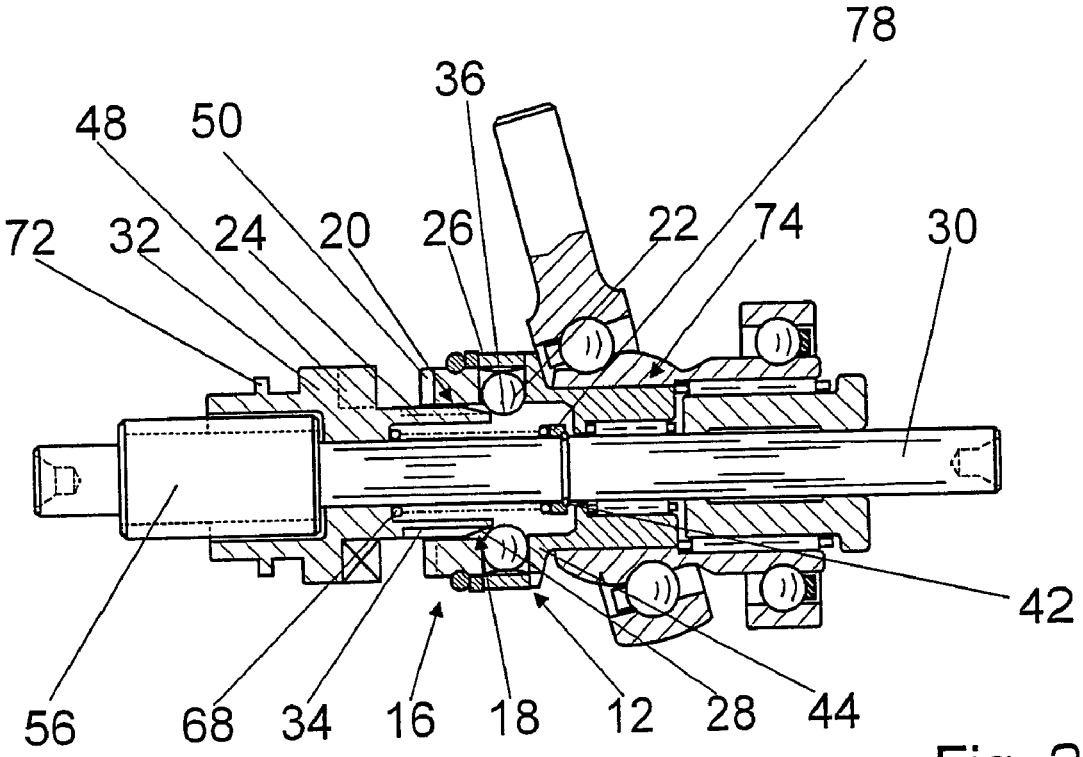
FIG. 2, a coupling device of the drill- and/or chipping hammer of FIG. 1, in an idling position.
Figure 3:
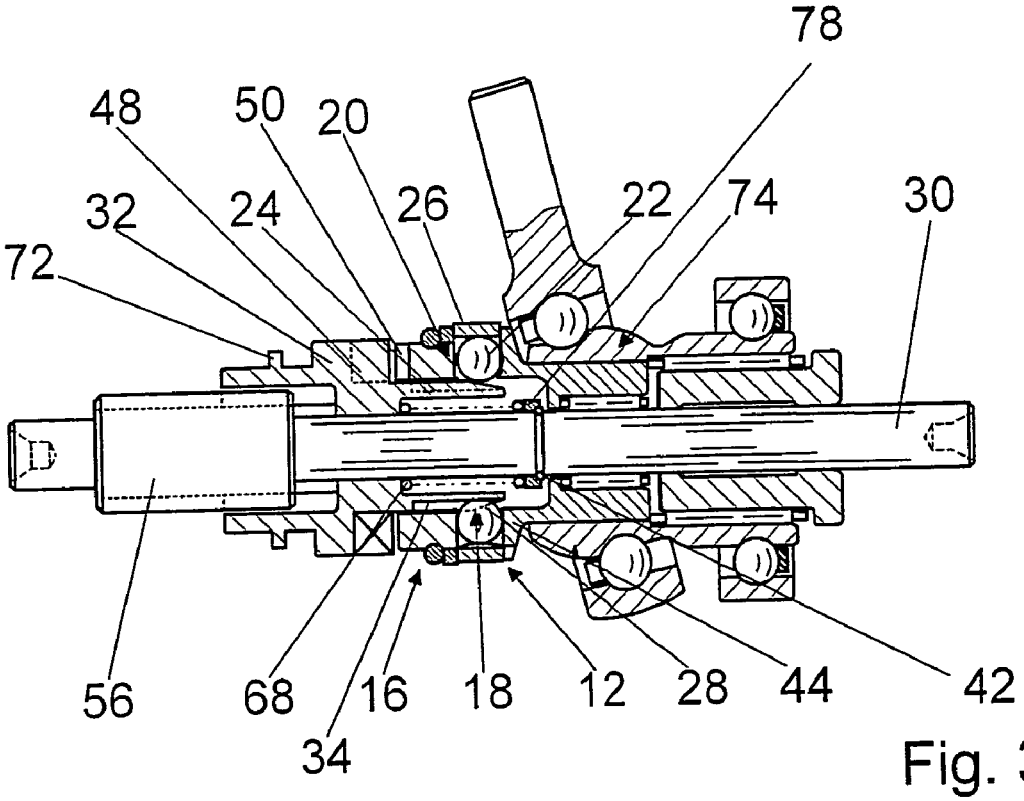
FIG. 3, the coupling device of FIG. 2 during a synchronizing operation.
Figure 4:
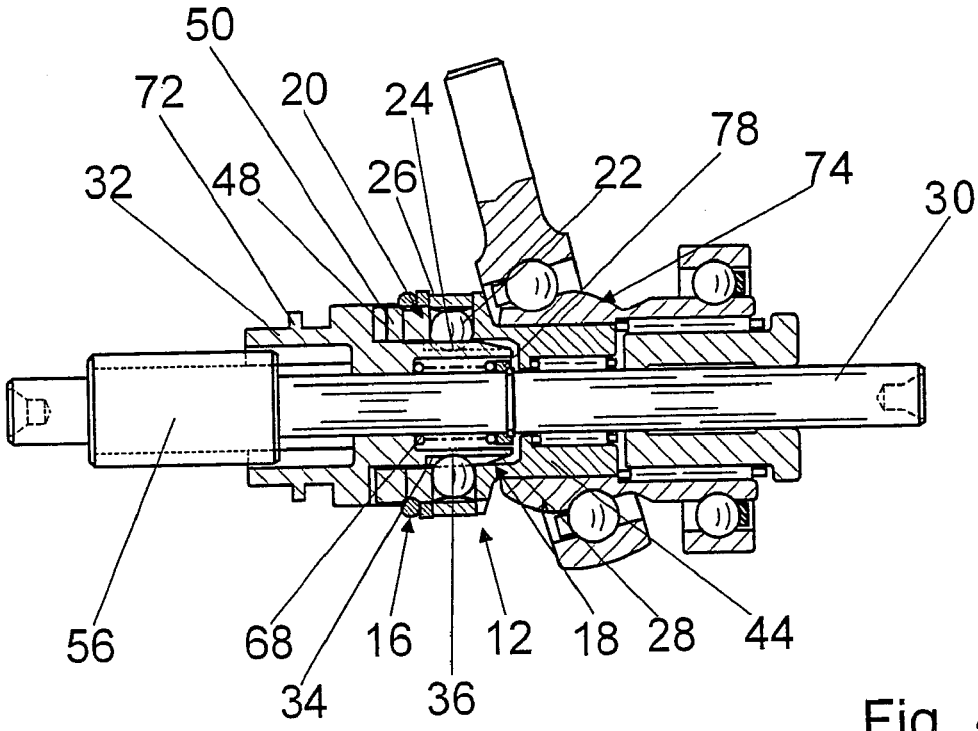
FIG. 4, the coupling device of FIG. 2 in a percussion drilling position.

The detent elements 22 embodied as balls are surrounded radially outward by an annular spring 26. The synchronization behavior can be adjusted, in particular via the design of the detent elements 24 embodied as recesses and via the annular spring 26. FIGS. 2–4 show a process of engaging the coupling device 12. If the drill- and/or chipping hammer is pressed against a machining surface by a tool not shown further here, a reaction force is transmitted from the tool holder 54 to the detent disk 64, via a securing ring 38, the hammer tube 60, and a securing ring 40, and from the detent disk 64 to the first coupling element 32, via a positive-engagement connection 76, and in particular, the components 32, 54, 60, 64 are thrust farther into the housing 10. An annular groove 70 is formed onto an outer circumference of the detent disk 64, and this groove is engaged by a collar 72 formed onto the first coupling element 32. The annular groove 70 and the collar 72 form the positive-engagement connection 76 in the axial direction between the detent disk 64 and the first coupling element 32 (FIG. 1).

Via the detent disk 64 and via the connection 76, the first coupling element 32 is thrust into the second coupling element 44, counter to an idling spring 68. The idling spring 68, embodied as a helical compression spring, is disposed on the shaft 30 and is braced, by its end remote from the tool holder 54, on the shaft 30 via a bracing ring 78 and a securing ring 42 secured in an annular groove of the shaft 30. With its end toward the tool holder 54, the idling spring 68 protrudes axially into an annular recess between the first coupling element 32 and the shaft 30 and acts with a compressive force in the direction of the tool holder 54 on a stop formed onto the first coupling element 32.

The detent elements 22 embodied as balls are displaced radially outward counter to the annular spring 26 along the conical face 28, at the onset of the synchronizing operation (FIGS. 2 and 3). In the process, the detent elements 22 embodied as balls come into operative contact with the detent elements 24 embodied as recesses. An unlockable positive engagement is attained, because the detent elements 22 embodied as balls, during the synchronizing operation, can become unlocked radially outward at an overlooking moment from their detent positions, specifically from the detent elements 24 embodied as recesses, counter to the annular spring 26 (FIG. 3). The first coupling element 32, via the unlockable positive engagement, accelerates the second coupling element 44, and beyond the conical face 28, a maximum torque of the detent mechanism 20 is attained.

After a synchronization of the first and second coupling elements 32, 44, clawlike positive-engagement elements 48, formed onto the first coupling element 32 and extending axially in the direction toward the second coupling element 44, come into engagement with correspondingly embodied clawlike positive-engagement elements 50, which are formed onto the second coupling element 44 and extend axially in the direction toward the first coupling element 32. The detent mechanism 20 is bridged, and the beater mechanism 14 is driven via the positive-engagement elements 48, 50 (FIG. 4). If the drive moment exceeds an allowable value during operation, the gear wheel 58 is deflected counter to an overlock spring 66 in the axial direction toward the tool holder 54, and the drive connection of the tool with the electric motor is broken. FIGS. 1 and 4 show the drill- and/or chipping hammer and the coupling device 12 in a percussion drilling position.

When the drill- and/or chipping hammer is lifted from the machining surface, the first detent element 32, via the connection 76; the detent disk 64, via the securing ring 40; the hammer tube 60; and the tool holder 54, via the securing ring 38, are all are displaced axially into their outset position in the direction of the machining surface by the spring 68. The idling spring 68 is reinforced in its mode of operation here by an idling stop of a beater 80, guided in the hammer tube 60; specifically, a pulse of the beater 80 is transmitted to the first coupling element 32, via a snap die 46, the tool holder 54, the hammer tube 60, the detent disk 64, and the connection 76.

In FIGS. 6–10, a further exemplary embodiment with an alternative coupling device 100 is shown. Components remaining essentially the same are all identified by the same reference numerals. Moreover, for characteristics and functions that remain the same, reference may be made to the description of the exemplary embodiment in FIGS. 1–5.

Figure 6:
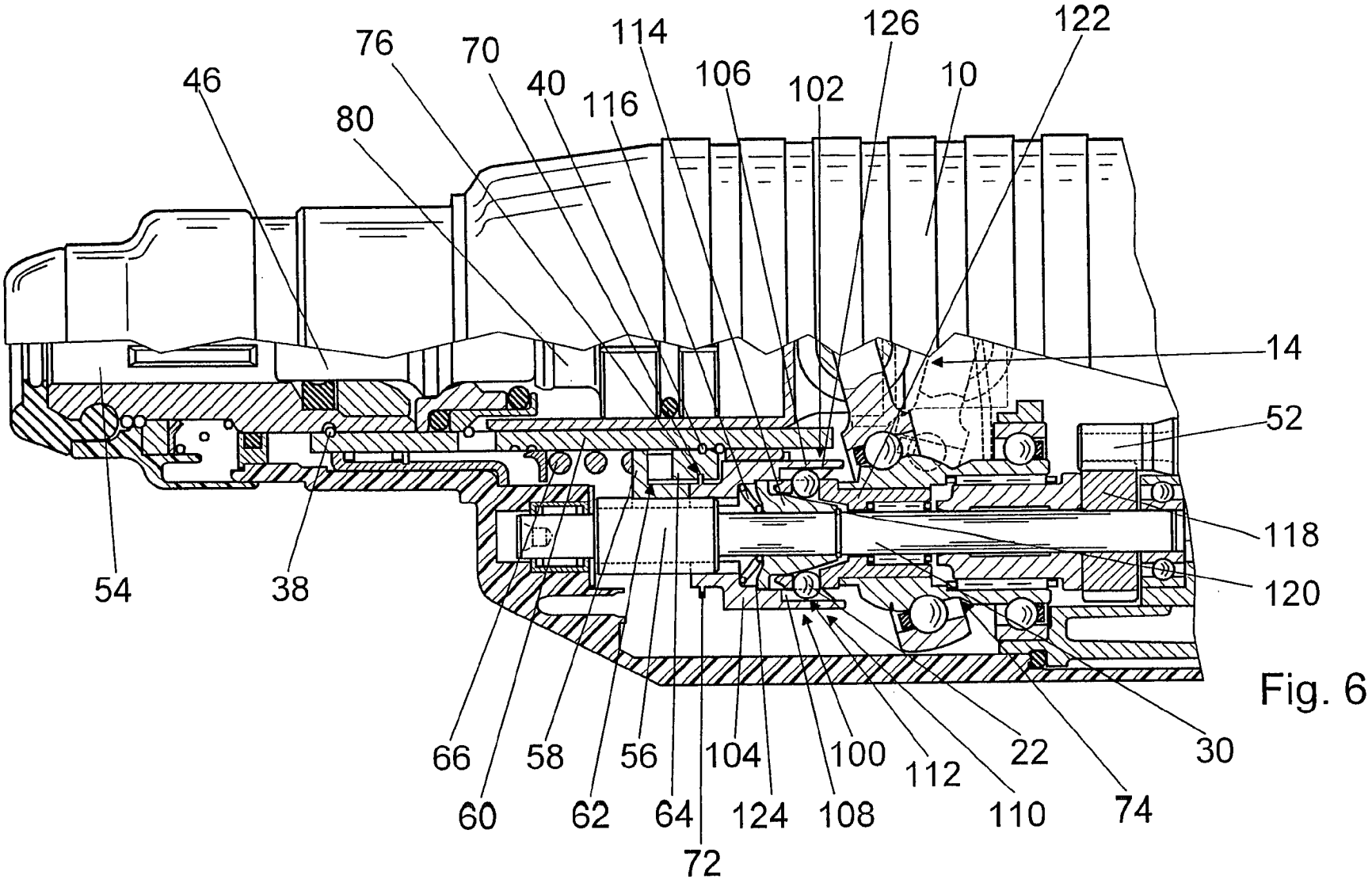
FIG. 6, a fragmentary section through a drill- and/or chipping hammer with an alternative coupling device.

A beater mechanism 14 is rotatably supported by a drive bearing 74 on a shaft 30. Also supported on the shaft 30 is a coupling device 100, which can be engaged and disengaged in order to make and break a drive connection 102 of the beater mechanism 14. The coupling device 100, on a side of a gear wheel 56 remote from a tool holder 54, has a first coupling element 104 that is axially displaceable on the shaft 30 and is supported thereon in a manner fixed against relative rotation. The first coupling element 104, on its end toward the tool holder 54, has a set of internal teeth, with which the first coupling element 104 is guided on the gear wheel 56 axially displaceably and in a manner fixed against relative rotation (FIG. 6).

A sleeve 106 is formed onto the first coupling element 104, on its side remote from the tool holder 54, and fits over a second, corresponding coupling element 122. The second coupling element 122 forms one part of the drive bearing 74 of the beater mechanism 14.

Figure 10:
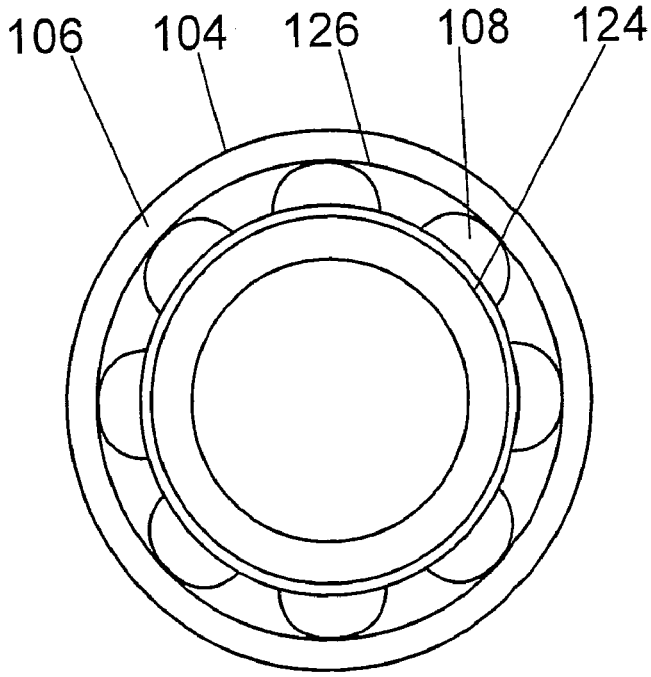
FIG. 10, a coupling element of the coupling device of FIG. 6 seen in the axial direction.

The sleeve 106, on its inside circumference, has detent elements 108, embodied as recesses, of a detent mechanism 110 of a synchronizing device 112. The detent elements 108 extend obliquely radially outward toward one end remote from the tool holder 54 and have a decreasing depth, and in a final region before the end remote from the tool holder 54, the sleeve 106 has an inside diameter corresponding to a root circle 126 of the detent elements 108 (FIG. 10). The detent elements 108 have a domelike cross-sectional area.

Radially inside the sleeve 106, a conical ring 114 is supported on the shaft 30, in a manner fixed against relative rotation and displaceably in the axial direction. The conical ring 114 is displaceable counter to a spring 116 on a side toward the tool holder 54. In the direction opposite the tool holder 54, the conical ring 114 is braced on the shaft 30 via a securing ring 120 secured in an annular groove of the shaft 30. The spring 115 is formed by a helical compression spring, which has an increasing diameter in the direction of the tool holder 54 and is disposed between the first coupling element 104 and the conical ring 114. With its end toward the tool holder 54, the spring 116 is braced in an annular recess on a collar of the first coupling element 104. On its end remote from the tool holder 54, the spring 166 is braced on the conical ring 114 (FIGS. 6–10). The synchronization behavior can be adjusted by way of the choice of the spring 116, by way of a conical angle of the conical ring 114, and by way of the detent elements embodied as recesses, and in particular by way of a transition to the recesses.

In the second coupling element 122, detent elements 22 embodied as balls in the detent mechanism 110 are supported in a plurality of bores extending radially and distributed over the circumference. The detent elements 22 embodied as balls protrude with one part radially inward beyond an inside circumference of the second coupling element 122 and in the process are braced on the inside on the conical ring 114 that is displaceable counter to the spring 116 (FIGS. 6–9).

Figure 7:
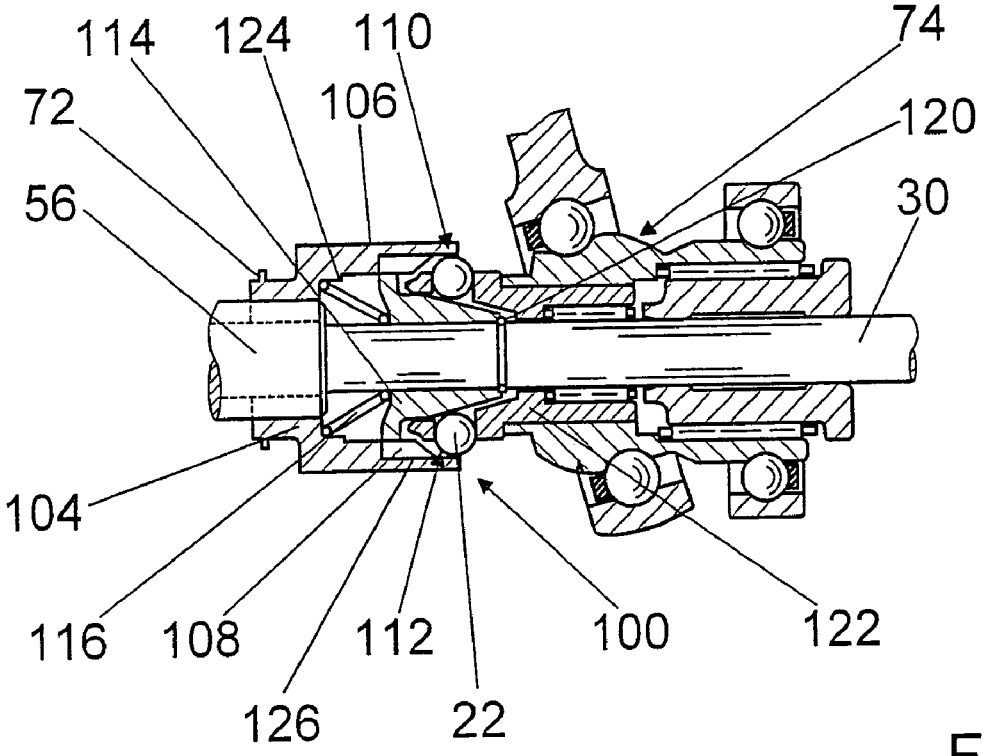
FIG. 7, the coupling device of FIG. 6 in an idling position.

In FIG. 7, the coupling device 100 is shown in the disengaged state. If the drill- and/or chipping hammer is pressed against a machining surface by a tool, not shown in detail here, a reaction force is transmitted from the tool holder 54 to the detent disk 64, via a securing ring 38, the hammer tube 60, and a securing ring 40, and from the detent disk 64 to the first coupling element 104 via a positive-engagement connection 76; in particular, the components 54, 60, 64 and 104 are thrust farther into the housing 10. An annular groove 70 is formed onto an outer circumference of the detent disk 64, and this groove is engaged by a collar 72 that is formed onto the first coupling element 104. The annular groove 70 and the collar 72 form the positive-engagement connection 76 in the axial direction between the detent disk 64 and the first coupling element 104.

Figure 8:
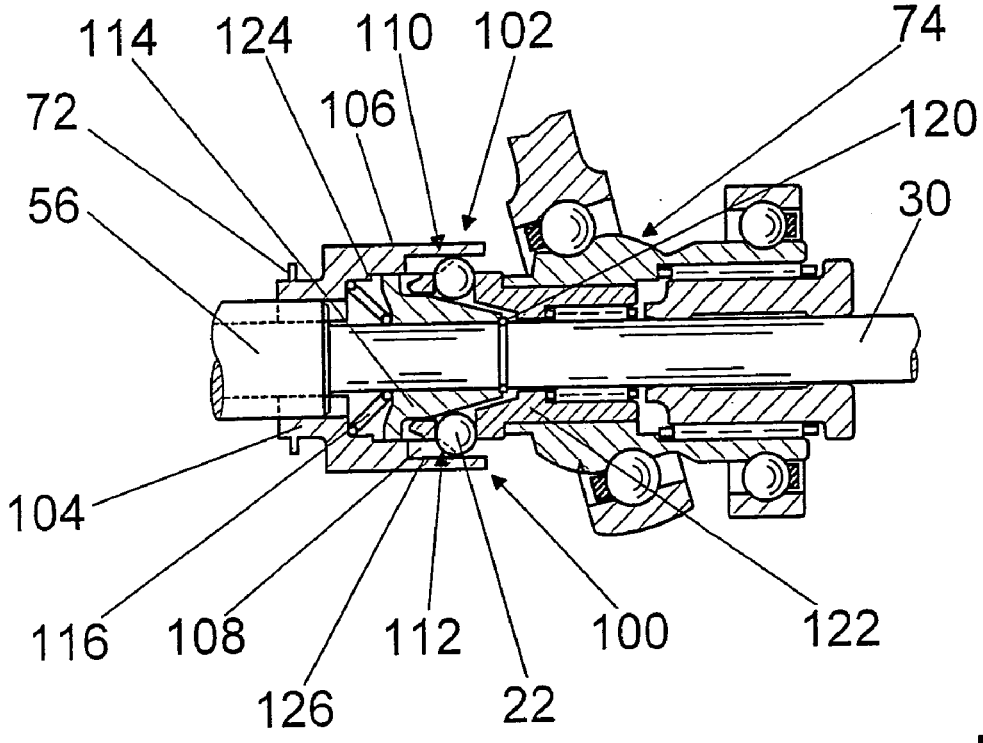
FIG. 8, the coupling device of FIG. 6 during a synchronizing operation.

The first coupling element 104 is displaced counter to the spring 116 via the second coupling element 122. The spring 116 is prestressed and transmits the axial motion of the first coupling element 104, with a compressive force, onto the conical ring 114. The detent elements 22 embodied as balls are forced radially outward by the conical ring 114 against the sleeve 106 of the first coupling element 104 (FIG. 8).

Because of the axial motion of the first coupling element 104 in the direction of the beater mechanism 14, the detent elements 22 embodied as balls come into operative contact with the detent elements 108, embodied as recesses, of the first coupling element 104. An unlockable positive engagement is attained, because the detent elements 22 embodied as balls, during the synchronizing operation, can become unlocked radially outward at an overlooking moment from their detent positions, specifically from the detent elements 108 embodied as recesses, counter to the conical ring 114, and the conical ring 114 can be displaced counter to the spring 116 in the direction of the tool holder 54. The first coupling element 104, via the unlockable positive engagement, accelerates the second coupling element 122 (FIG. 8).

Figure 9:
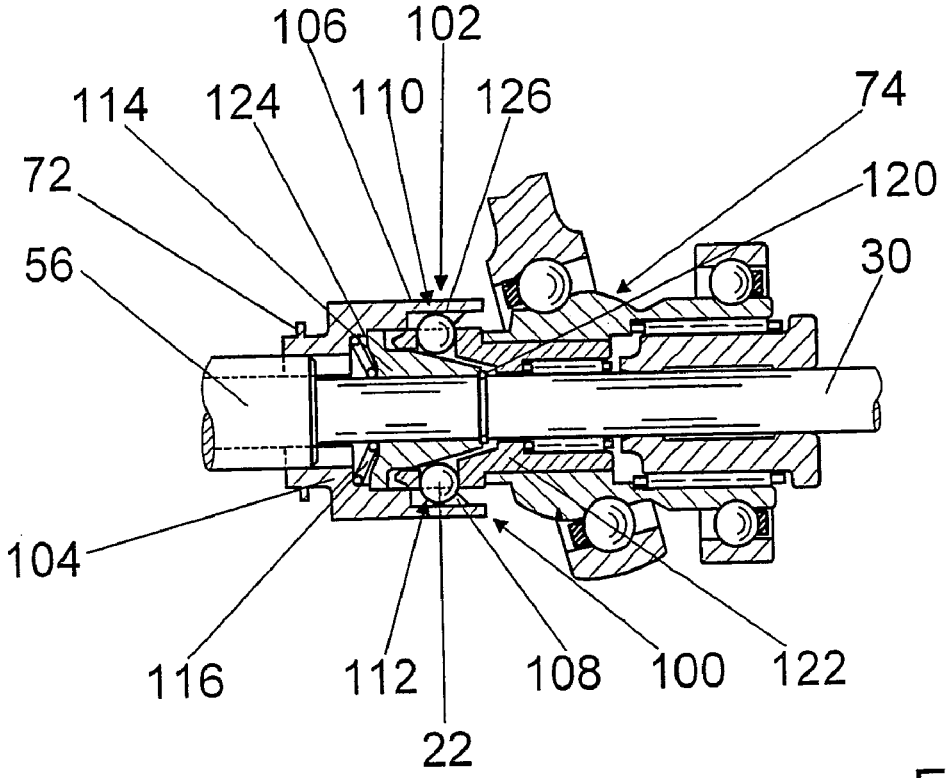
FIG. 9, the coupling device of FIG. 6 in a percussion drilling position.

Once the drive connection 102 has been made, the conical ring 114 is fixed axially in the direction of the tool holder 54 by means of a stop 124 of the first coupling element 104 (FIGS. 6 and 9). The detent elements 22 embodied as balls are braced radially inward on the axially fixed conical ring 114 and are securely compartmented in the corresponding detent elements 108 embodied as recesses. As a result of the stop 124, unlocking of the detent elements 22 is avoided, and the detent elements 22, 108 form a positive-engagement connection between the first and second coupling elements 104, 122. If the drive moment exceeds an allowable value during operation, the gear wheel 58 is deflected in the axial direction toward the tool holder 54 counter to an overlock spring 66, and the drive connection is broken.

FIGS. 6 and 9 show the drill- and/or chipping hammer and the coupling device 112 in a percussion drilling position. When the drill- and/or chipping hammer is lifted from the machining surface, the first coupling element 104, via the connection 76; the detent disk 64, via the securing ring 40; the hammer tube 60; and the tool holder 54, via the securing ring 38, are all are displaced axially into their outset position in the direction of the machining surface by the spring 116. In the process, the spring 116 is reinforced in its mode of operation by an idling stop of a beater 80 guided in the hammer tube 60; specifically, a pulse of the beater 80 is transmitted to the first coupling element 104 via a snap die 46, the tool holder 54, the hammer tube 60, and the detent disk 64, and the connection 76.

Figure 11:
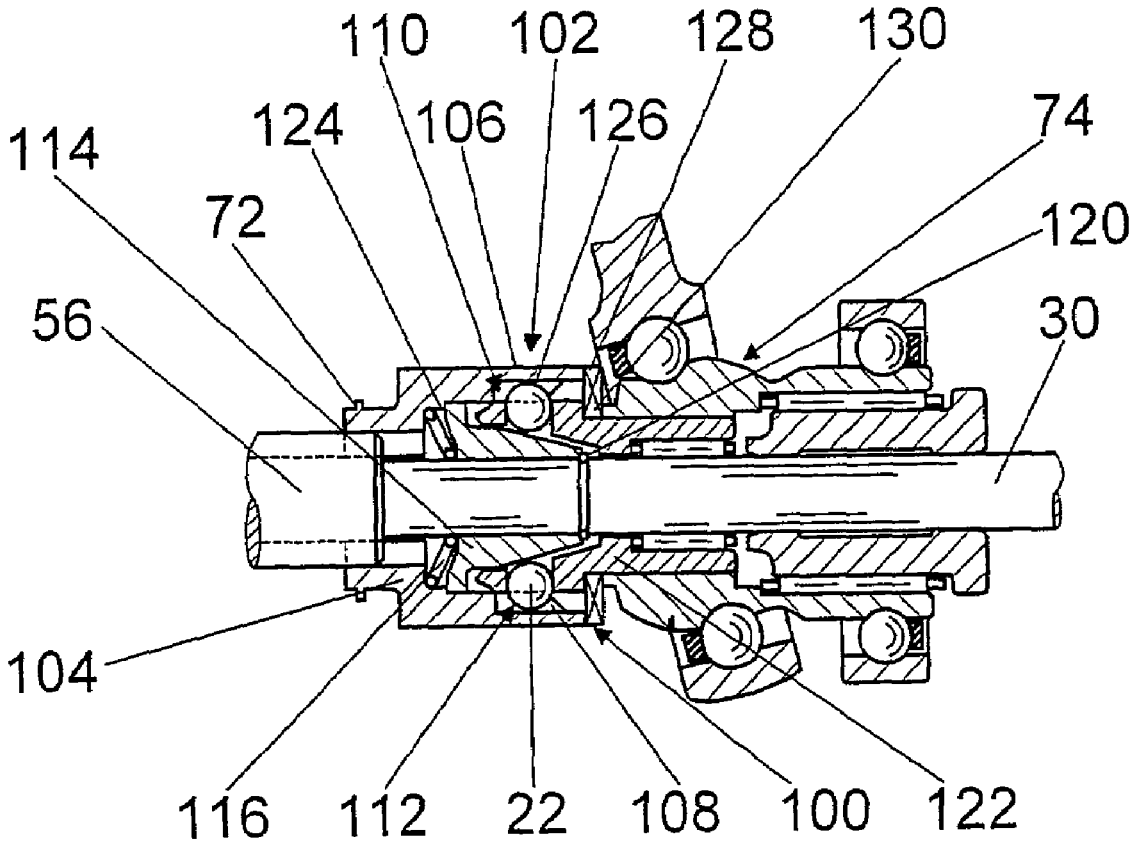
FIG. 11, a coupling device that is an alternative to FIG. 6, with additional positive-engagement elements.

FIG. 11 shows a variant of the coupling device 100 of FIG. 7. After a synchronization of the first and second coupling elements 104, 122, clawlike positive-engagement elements 128 formed onto the first coupling element 104 and extending axially in the direction of the second coupling element 122 come into engagement with correspondingly embodied clawlike positive-engagement elements 130 that are formed onto the second coupling element 122 and extend axially in the direction toward the first coupling element 104. The detent mechanism 110 is bridged, and the beater mechanism 14 is driven via the positive-engagement elements 128, 130.

| List of Reference Numerals | |
|---|---|
| 10 | Housing |
| 12 | Coupling device |
| 14 | Beater mechanism |
| 16 | Drive connection |
| 18 | Synchronizing device |
| 20 | Detent mechanism |
| 22 | Detent element |
| 24 | Detent element |
| 26 | Annular spring |
| 28 | Conical face |
| 30 | Shaft |
| 32 | Coupling element |
| 34 | Root inner circle |
| 36 | Root inner circle |
| 38 | Securing ring |
| 40 | Securing ring |
| 42 | Securing ring |
| 44 | Coupling element |
| 46 | Snap die |
| 48 | Positive-engagement element |
| 50 | Positive-engagement element |
| 52 | Drive shaft |
| 54 | Tool holder |
| 56 | Gear wheel |
| 58 | Gear wheel |
| 60 | Hammer tube |
| 62 | Overlock coupling |
| 64 | Detent disk |
| 66 | Overlock spring |
| 68 | Idling spring |
| 70 | Annular groove |
| 72 | Collar |
| 74 | Drive bearing |
| 76 | Connection |
| 78 | Bracing ring |
| 80 | Beater |
| 100 | Coupling device |
| 102 | Drive connection |
| 104 | Coupling element |
| 106 | Sleeve |
| 108 | Detent element |
| 110 | Detent mechanism |
| 112 | Synchronizing device |
| 114 | Conical ring |
| 116 | Spring |
| 118 | Fixed wheel |
| 120 | Securing ring |
| 122 | Coupling element |
| 124 | Stop |
| 126 | Root circle |
| 128 | Positive-engagement element |
| 130 | Positive-engagement element |

The invention claimed is:

1. A drilling- and/or chipping hammer having a beater mechanism (14) and a coupling device (12, 100), which is engageable and disengageable in order to make and break a drive connection (16, 102) of the beater mechanism (14), wherein the coupling device (12, 100) has a synchronizing device (18, 112), with a detent mechanism (20, 110) which transmits a drive moment to the beater mechanism (14) and which has at least two corresponding detent elements (22, 24, 108), wherein said coupling device (12, 100) has two coupling elements (32, 44, 104, 122), wherein the two coupling elements (32, 44, 104, 122) are synchronized by the synchronizing device (18, 112) when the coupling device (12, 100) is engaged, at least one of the detent elements (22) being movable about its detent position upon an overlooking moment, counter to a spring force of a spring element (26, 116), wherein said coupling elements (32, 44, 104, 122) have correspondingly embodied clawlike positive-engagement elements (48, 50) bridging said synchronizing device (18, 112) when the coupling device (12) is fully engaged.

2. The drilling- and/or chipping hammer of claim 1, wherein the detent element (22) that is movable counter to a spring force is formed by a roller body, and the detent element (24, 108), corresponding to the detent element (22) embodied as a roller body, is formed by a recess.

3. The drilling- and/or chipping hammer of claim 2, wherein the detent element (22) embodied as a roller body is formed by a ball, which is braced on a conical ring (114) that is displaceable on a drivable shaft axially counter to a spring (116).

4. The drilling- and/or chipping hammer of claim 3, wherein the conical ring (114), once the drive connection is made, is axially fixed by a stop (124).

5. The drilling- and/or chipping hammer of claim 3, wherein the detent element (22) embodied as a ball is braced radially inward on the displaceable conical ring (114) and can be brought radially outward into operative connection with the corresponding detent element (108) as a recess.

6. The drilling- and/or chipping hammer of claim 1, wherein the detent element (22) is movable out of its detent position counter to an annular spring (26).

7. The drilling- and/or chipping hammer of claim 6, wherein the detent element (22), at the onset of the synchronizing operation, is displaced along a conical face (28) counter to the annular spring (26).

8. The drilling- and/or chipping hammer of claim 7, wherein the conical face (28) is formed onto one end of a component that is displaceable axially and fixed against relative rotation on a drivable shaft (30), and a detent element (24) embodied as a recess extends into the conical face (28).

9. The drilling- and/or chipping hammer of claim 8, wherein at the onset of the synchronizing operation, the detent element (22) is guided radially outward along the conical face (28).

10. The drilling- and/or chipping hammer of claim 8, wherein a component (64) that transmits a pulse of the beater mechanism (14) is connected to the displaceable component (32) via a connection (76), which transmits a force in the pulse direction.

11. The drilling- and/or chipping hammer of claim 1, wherein a curvature radius of at least two detent elements (22) embodied as recesses is the same as a curvature radius of the detent elements (22) embodied as roller bodies.

12. The drilling- and/or chipping hammer of claim 1, wherein the detent element (22) is supported in one part of a drive element (74) of the beater mechanism (14).

13. The drilling- and/or chipping hammer of claim 1, wherein the coupling device (12) has positive-engagement elements (48, 50, 128, 130), which after the synchronizing operation come into engagement along with the detent mechanism (20, 110).

* * * * *